US009091139B2

(12) United States Patent
Weng et al.

(10) Patent No.: US 9,091,139 B2
(45) Date of Patent: Jul. 28, 2015

(54) METHOD FOR DETERMINING CHARACTERISTICS OF TUBING DEPLOYED IN A WELLBORE

(75) Inventors: Xiaowei Weng, Katy, TX (US); Fernando Baez Manzanera, Doral, FL (US); Douglas Pipchuk, Calgary (CA); Rex Burgos, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 297 days.

(21) Appl. No.: 12/962,277

(22) Filed: Dec. 7, 2010

(65) Prior Publication Data

US 2011/0144960 A1 Jun. 16, 2011

Related U.S. Application Data

(60) Provisional application No. 61/285,769, filed on Dec. 11, 2009.

(51) Int. Cl.

| | |
|---|---|
| ***G06G 7/48*** | (2006.01) |
| ***E21B 44/00*** | (2006.01) |
| ***E21B 34/06*** | (2006.01) |

(52) U.S. Cl.

CPC ..... *E21B 44/00* (2013.01); *E21B 34/06* (2013.01)

(58) Field of Classification Search

CPC ..... E21B 47/12; E21B 34/06; E21B 41/00
USPC ..... 703/10
See application file for complete search history.

(56) References Cited

U.S. PATENT DOCUMENTS

| | | | | |
|---|---|---|---|---|
| 6,433,242 | B1 | 8/2002 | Wiese | |
| 6,443,242 | B1 | 9/2002 | Newman et al. | |
| 7,448,448 | B2 * | 11/2008 | Lovell et al. | 166/279 |
| 8,504,341 | B2 * | 8/2013 | Cullick et al. | 703/10 |
| 2007/0137860 | A1 * | 6/2007 | Lovell et al. | 166/250.01 |
| 2008/0308272 | A1 | 12/2008 | Thomeer et al. | |
| 2014/0019106 | A1 * | 1/2014 | Jiang et al. | 703/10 |

OTHER PUBLICATIONS

Johncsik, C. A., Friesen, D. B., and Dawson, R., "Torque and Drag in Directional Wells—Prediction and Measurement," IADC/SPE Paper 11380, IADC/SPE Drilling Conference, New Orleans, Feb. 20-23, 1983.*

(Continued)

*Primary Examiner* — David Silver
(74) *Attorney, Agent, or Firm* — Michael L. Flynn; Timothy Curington; Robin Nava

(57) ABSTRACT

A method for determining characteristics of a tubing deployed in a wellbore includes positioning a first sensor within the wellbore, wherein the first sensor generates a first feedback signal representing a downhole parameter measured by the first sensor, positioning a second sensor adjacent a surface of the formation in which the wellbore is formed, wherein the second sensor generates a second feedback signal representing a surface parameter measured by the second sensor, generating a simulated model representing a simulated surface weight indicator of the tubing, wherein the simulated model is derived from at least the first feedback signal, generating a data model representing a measured weight indicator of the tubing, wherein the data model is derived from the second feedback signal, comparing the data model to the simulated model, and adjusting a parameter of the simulated model to substantially match the simulated model to the data model.

17 Claims, 4 Drawing Sheets

(56) References Cited

OTHER PUBLICATIONS

Chen et al., "An Analysis of Tubing and Casing Buckling in Horizontal Wells," OTC 6037, Offshore Technology Conference, May 1989, pp. 617-620.

Van Adrichem et al., "Validation of Coiled Tubing Penetration Predictions in Horizontal Walls," SPE 24765, SPE 67th Annual Technical Conference and Exhibition, Oct. 4-7, 1992.

GCC Examination and Search Report for GCC Application No. 2010-17306 dated Dec. 3, 2014.

* cited by examiner

AFTER CALIBRATION

BEFORE CALIBRATION

AFTER CALIBRATION

BEFORE CALIBRATION

METHOD FOR DETERMINING CHARACTERISTICS OF TUBING DEPLOYED IN A WELLBORE

CROSS-REFERENCE TO RELATED APPLICATION

This application is entitled to the benefit of, and claims priority to, provisional patent application Ser. No. 61/285,769 filed Dec. 11, 2009, the entire disclosure of which is incorporated herein by reference.

BACKGROUND

The statements in this section merely provide background information related to the present disclosure and may not constitute prior art.

The present disclosure relates generally to wellbore treatment and development of a reservoir and, in particular, to a system and a method for determining characteristics of a tubing disposed in a wellbore.

In all stages of well construction for oil and gas extraction from a subterranean reservoir, including drilling, logging, completion and workover operations, a means of conveyance (i.e. tubing) is required to lower a tool, or tools, into the well to facilitate these operations. The tools may include a drilling bit, a logging tool, a packer, a downhole completion string such as a liner or a screen, a perforating gun, a jetting tool, and the like. The means of conveyance (i.e. tubing) can be a jointed pipe, a continuous pipe such as a coiled tubing (CT), or a slickline or wireline cable.

As the tubing moves into a well, the tubing is subjected to increasing forces along its length, as a result of a weight of the tubing itself, a buoyancy force of a fluid in the wellbore, a contact friction with the wall of the wellbore, a pressure inside the wellbore, and a load applied at the bottom of the tool being conveyed (also called weight on bit). Excessive force in tension or compression can cause the failure of the tubing or the tools coupled to the tubing, resulting in a failed operation, an expensive loss of production, or even a loss of the entire well.

To better plan, execute, and optimize the wellbore operations, mathematical models have been developed for computing the torque and drag forces in the drill pipe during drilling operations, especially for deviated and horizontal well drilling, as described in a paper by Johncsik et al. entitled "Torque and Drag in Directional Wells—Prediction and Measurement" and incorporated herein by reference in its entirety. (See Johncsik, C. A., Friesen, D. B., and Dawson, R., "Torque and Drag in Directional Wells—Prediction and Measurement," IADC/SPE Paper 11380, IADC/SPE Drilling Conference, New Orleans, Feb. 20-23, 1983).

Torque and drag models developed for drilling are also extended to applications using coiled tubing and cable. Unlike conventional jointed pipes, coiled tubing cannot stand substantial compression force and may be susceptible to buckling failure. Therefore, a plurality of Tubing Forces Models (TFM) for coiled tubing have been developed by incorporating buckling models, as described in a paper by Chen et al. entitled "An Analysis of Tubing and Casing Buckling in Horizontal Wells" and incorporated herein by reference in its entirety. (See Chen, Y. C., Lin, Y. H., and Cheatham, A. B., "An Analysis of Tubing and Casing Buckling in Horizontal Wells," OTC paper 6037, Offshore Technology Conference, May 1989).

Conventional TFMs are used extensively in various planning and job design processes and has been shown to predict the tubing force reasonably accurately when certain well parameters are known, as described in a paper by Van Adrichem et al. entitled "Validation of Coiled Tubing Penetration Predictions in Horizontal Wells" and incorporated herein by reference in its entirety. (See Van Adrichem, W. and Newman, K. R., "Validation of Coiled Tubing Penetration Predictions in Horizontal Wells," SPE paper 24765, SPE 67th Annual Technical Conference and Exhibition, Washington D.C., Oct. 4-7, 1992).

TFMs play a critical role in planning a well operation in an extended reach well to let the operator know beforehand whether a given tubing string can successfully reach a target depth without problem, and whether other means to extend the reach, such as friction reducers or mechanical tractors, is required.

For example, U.S. Pat. No. 6,433,242 discloses a method of running a TFM multiple times prior to a job to generate a simple (curve fitted) model for use during a job to be able to quickly match the measured surface CT weight. However, without integrating real-time downhole measurements, such exercise may lead to incorrect parameters that produce wrong calculations.

As a further example, U.S. Pat. Appl. Pub. No. 2008/0308272 discloses a general methodology of using downhole pressure, temperature, load, velocity and other measurements to provide continuous real-time closed loop interpretations to sense various types of downhole events.

However, some of the key parameters that affect tubing forces are not known accurately, which include the contact friction between the coiled tubing and the wellbore wall, the inherently unknown helical shape of the pipe due to the residual bending of the coiled tubing, and unknown tool contact force at the well bottom in drilling, milling or jetting operations. Other key parameters, such as a CT stripper force, a reel back tension, a fluid density, and a pressure, change constantly during the well operations, which also cause significant variations in tubing forces. Due to these reasons, the surface weight indicator as predicted by a TFM (based on the assumed parameters) sometimes does not match the actual measured CT weight. The mismatch could lead to undesired failures since the TFM is no longer providing the correct tubing forces calculation. Alternatively, the operator could adjust the input parameters to match the measured surface weight, but this process is non-unique since several factors can affect the measured weight as stated above. Incorrect assumptions of the parameters would again lead to errors in calculation.

In operations such as fill cleanout using coiled tubing, the fill materials can pile up in the wellbore, leading to increased apparent CT/wall friction. If the apparent friction can be estimated, it can be a good indicator for potential problems when too much fill materials are accumulated in the well, leading to a potential stuck pipe situation. Other operations include interventions in a deviated/horizontal open hole section, where a potentially collapsed bore hole could lead to additional CT/wall friction. Understanding when such friction increases will also prevent a stuck pipe situation.

Excessive forces on the CT, either tensile or compression, may cause the pipe to break or buckle. When a CT is running in a long horizontal well, the gravity force causes the CT to lie on the bottom of the wellbore. The contact friction between CT and wellbore leads to increased force building up along the part of the CT lying in the horizontal section of the well. If the CT is running in the hole, a compression force builds up. If it exceeds a critical value, the CT undergoes helical buckling, leading to CT lock up in the well.

In order to accurately predict tubing forces during a well operation, simulated models (e.g. TFM) must use additional downhole measurements to reduce the uncertainty of the parameters, including measured downhole pressure and force at the bottom, and potentially other parameters.

This disclosure describes a method of using the real-time measurements to calibrate the TFM parameters and use the calibrated parameters to predict tubing forces more accurately and to overcome the shortcomings of the prior art.

SUMMARY

In one embodiment, a method for determining characteristics of a tubing deployed in a wellbore formed in a formation, comprises: positioning a first sensor within the wellbore, wherein the first sensor generates a first feedback signal representing a downhole parameter measured by the first sensor; positioning a second sensor adjacent a surface of the formation in which the wellbore is formed, wherein the second sensor generates a second feedback signal representing a surface parameter measured by the second sensor; generating a simulated model representing a simulated surface weight indicator of the tubing, wherein the simulated model is derived from at least the first feedback signal; generating a data model representing a measured weight indicator of the tubing, wherein the data model is derived from the second feedback signal; comparing the data model to the simulated model; and adjusting a parameter of the simulated model to substantially match the simulated model to the data model.

In another embodiment, a method for determining characteristics of a tubing deployed in a wellbore formed in a formation, comprises: positioning a first sensor within the wellbore, wherein the first sensor generates a first feedback signal representing a downhole parameter measured by the sensor; positioning a second sensor adjacent a surface of the formation in which the wellbore is formed, wherein the second sensor generates a second feedback signal representing a surface parameter measured by the second sensor; generating a simulated model based upon an instruction set, the simulated model representing a simulated surface weight indicator of the tubing, wherein the simulated model is derived from at least the first feedback signal; generating a data model representing a measured weight indicator of the tubing, wherein the data model is derived from the second feedback signal; comparing the data model to the simulated model; adjusting at least one parameter of the simulated model to substantially match the simulated model to the data model; and analyzing the at least one parameter in real-time to determine a change in characteristics of at least one of the tubing and the wellbore.

In yet another embodiment, a method for determining characteristics of a tubing deployed in a wellbore formed in a formation, comprises: positioning a sensor within the wellbore, wherein the sensor generates a feedback signal representing a downhole parameter measured by the sensor; generating a simulated model including a parameter representing a coefficient of friction between the tubing and the wellbore, the simulated model representing forces acting on the tubing, wherein the simulated model is derived from at least the feedback signal; comparing a value of the parameter representing a coefficient of friction between the tubing and the wellbore of the simulated model to a pre-defined value; and adjusting the pre-defined value to substantially match the value of the parameter representing the coefficient of friction between the tubing and the wellbore of the simulated model.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
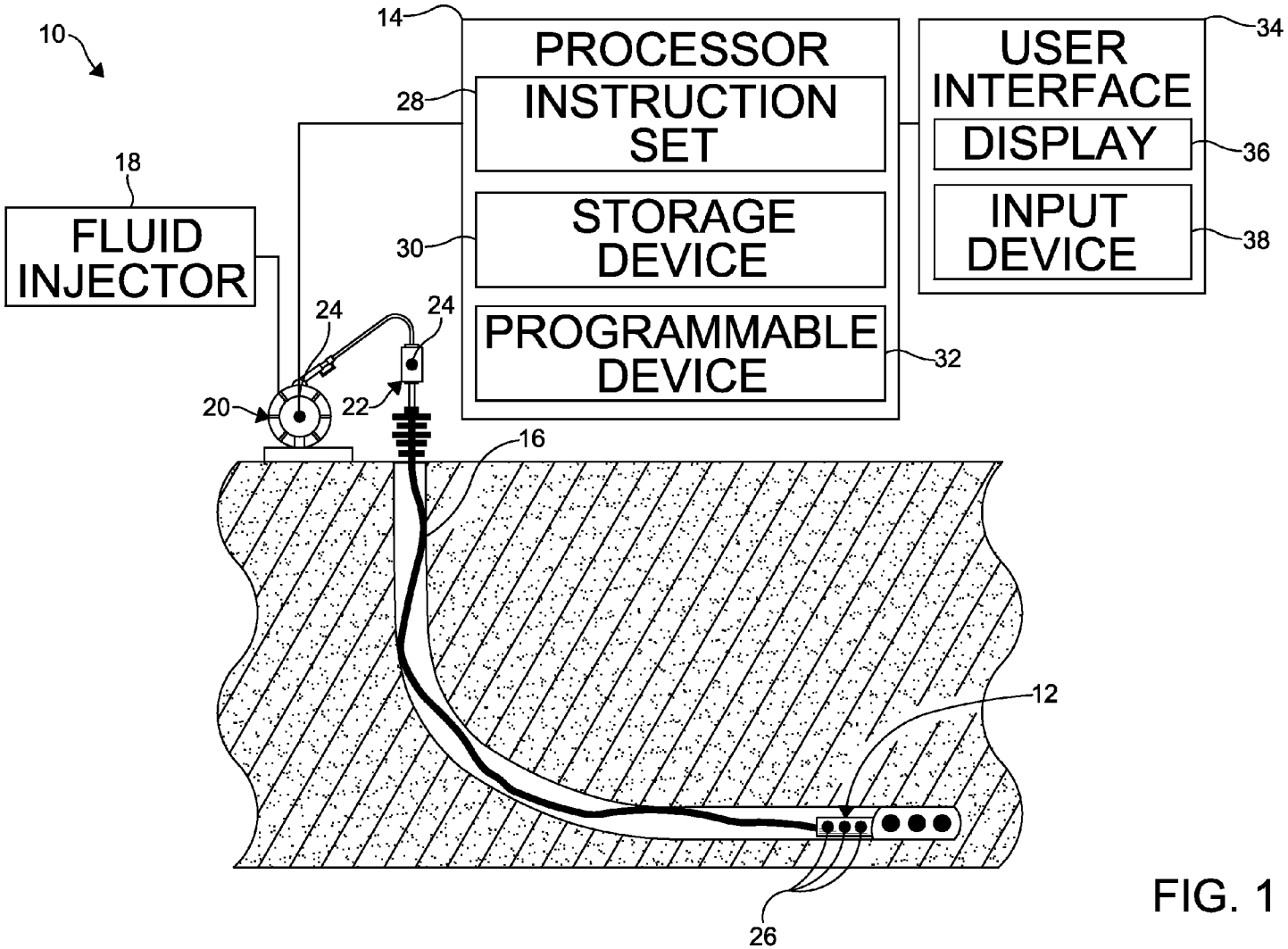
FIG. 1 is a schematic block diagram of an embodiment of a wellbore system.

Referring now to FIG. 1, there is shown an embodiment of a wellbore operation system, indicated generally at 10.

As shown, the system 10 generally includes a bottom hole assembly (BHA) 12 in signal communication with a processor 14. It is understood that the BHA 12 can include various tooling for performing various downhole operations. As a non-limiting example, the BHA 12 can include a jetting nozzle (not shown) to breakdown and remove sand fills in the wellbore. However, any tools can be included for any downhole operation, now known or later developed. It is further understood that the system 10 may include additional components.

The BHA 12 is coupled to a means for conveyance (i.e. tubing 16). The tubing 16 is typically one of a jointed pipe, a continuous pipe such as a coiled tubing (CT), and a slickline or wireline cable. However, other tubing or suitable means for conveyance of the BHA 12 can be used.

In certain embodiments, the BHA 12 is in fluid communication with a fluid injector 18 via the tubing 16. As such, the tubing 16 allows the BHA 12 to be positioned in a wellbore formed in a formation to selectively direct a fluid to a particular depth or layer of the formation.

In the embodiment shown, the tubing 16 is a coiled tubing (CT) spooled on a drum 20 and selectively deployed into the wellbore. As a non-limiting example, a stripper 22 is disposed between the drum 20 and the wellbore to provide a seal around the tubing 16 to isolate a pressure in the wellbore, while allowing the tubing 16 to pass therethrough. As a further non-limiting example, a plurality of surface sensors 24 are configured to measure at least a surface weight of the tubing 16 (or indicator(s) of various forces acting on the tubing 16). In certain embodiments, the actual measurement of weight is made with a hydraulic gauge attached to the tubing 16. However, it is understood that other sensors can be configured to measure various surface level parameters such as a wellhead pressure and surface pressure, for example.

In the embodiment shown, the BHA 12 includes a plurality of wellbore sensors 26. As a non-limiting example, the wellbore sensors 26 include one or more pressure sensors, temperature sensors, load sensors, casing collar locator sensors, fluid characteristic sensors (e.g. fluid velocity sensors), acoustic sensors, infrared sensors, optical sensors, flow sensors, and other types of sensors designed to detect and monitor one or more properties that can be used as an indicator of a downhole event. The wellbore sensors 26 are in signal communication with the processor 14 to provide real-time measurement data (via feedback signals) representing various downhole parameters. It is understood that the wellbore sensors 26 can communicate with the processor 14 by various means of telemetry, such as a fiber optic line, an electrical line, and an acoustic pulsing, for example.

The processor 14 is in data communication with the surface sensors 24 and the wellbore sensors 26 to receive data signals (e.g. a sensor feedback signal) therefrom and analyze the signals based upon a pre-determined algorithm, mathematical process, or equation, for example. As shown, the processor 14 analyzes and evaluates a received data based upon an instruction set 28. The instruction set 28, which may be embodied within any computer readable medium, includes processor executable instructions for configuring the processor 14 to perform a variety of tasks and calculations. As a non-limiting example, the instruction set 28 may include a comprehensive suite of equations governing a tubing forces model (TFM). As a further non-limiting example, the instruction set 28 includes a comprehensive model for predicting and measuring torque and drag in directional wells as described in the paper by Johncsik et al. entitled "Torque and Drag in Directional Wells—Prediction and Measurement" and incorporated herein by reference in its entirety. (See Johncsik, C. A., Friesen, D. B., and Dawson, R., "Torque and Drag in Directional Wells—Prediction and Measurement," IADC/SPE Paper 11380, IADC/SPE Drilling Conference, New Orleans, Feb. 20-23, 1983). As another non-limiting example, the instruction set 28 includes a comprehensive model for the analysis of the tubing 16 as described in the paper by Chen et al. entitled "An Analysis of Tubing and Casing Buckling in Horizontal Wells" and incorporated herein by reference in its entirety. (See Chen, Y. C., Lin, Y. H., and Cheatham, A. B., "An Analysis of Tubing and Casing Buckling in Horizontal Wells," OTC paper 6037, Offshore Technology Conference, May 1989). As a further non-limiting example, the instruction set 28 includes a comprehensive model for predicting a penetration of the tubing 16 in a horizontal well as described in the paper by Van Adrichem et al. entitled "Validation of Coiled Tubing Penetration Predictions in Horizontal Wells" and incorporated herein by reference in its entirety. (See Van Adrichem, W. and Newman, K. R., "Validation of Coiled Tubing Penetration Predictions in Horizontal Wells," SPE paper 24765, SPE 67th Annual Technical Conference and Exhibition, Washington D.C., Oct. 4-7, 1992). It is understood that any equations can be used to model the forces acting on the tubing 16 in the wellbore, as appreciated by one skilled in the art of wellbore operations. It is further understood that the processor 14 may execute a variety of functions such as controlling various settings of the surface sensors 24, the wellbore sensors 26, and the fluid injector 18, for example.

As a non-limiting example, the processor 14 includes a storage device 30. The storage device 30 may be a single storage device or may be multiple storage devices. Furthermore, the storage device 30 may be a solid state storage system, a magnetic storage system, an optical storage system or any other suitable storage system or device. It is understood that the storage device 30 is adapted to store the instruction set 28. In certain embodiments, data retrieved from the surface sensors 24 and the wellbore sensors 26 is stored in the storage device 30 such as a temperature measurement and a pressure measurement, and a history of previous measurements and calculations, for example. Other data and information may be stored in the storage device 30 such as the parameters calculated by the processor 14, a database of petrophysical and mechanical properties of various formations, a database of mechanical properties of various types of tubing, and data tables used in reservoir characterization in various drilling operations (e.g. underbalanced drilling characterization), for example. It is further understood that certain known parameters and numerical models for various formations and fluids may be stored in the storage device 30 to be retrieved by the processor 14.

As a further non-limiting example, the processor 14 includes a programmable device or component 32. It is understood that the programmable device or component 32 may be in communication with any other component of the system 10 such as the fluid injector 18, the surface sensors 24, and the wellbore sensors 26, for example. In certain embodiments, the programmable component 32 is adapted to manage and control processing functions of the processor 14. Specifically, the programmable component 32 is adapted to control the analysis of the data signals (e.g. feedback signal generated by the surface sensors 24 and the wellbore sensors 26) received by the processor 14. It is understood that the programmable component 32 may be adapted to store data and information in the storage device 30, and retrieve data and information from the storage device 30.

In certain embodiments, a user interface 34 is in communication, either directly or indirectly, with at least one of the BHA 12, the fluid injector 18, the surface sensors 24, the wellbore sensors 26, and the processor 14 to allow a user to selectively interact therewith. In certain embodiments, the user interface 34 is a human-machine interface allowing a user to selectively and manually modify parameters of a computational model generated by the processor 14. As a non-limiting example, the user interface 34 includes a display 36 to present a visual feedback to an operator, and an input device 38, such as a keypad or touchscreen, to enable the operator to input information. Additionally, a variety of transmitters and receivers (not shown) can be used to intercommunicate with a remotely located computer, for example.

Figure 2:
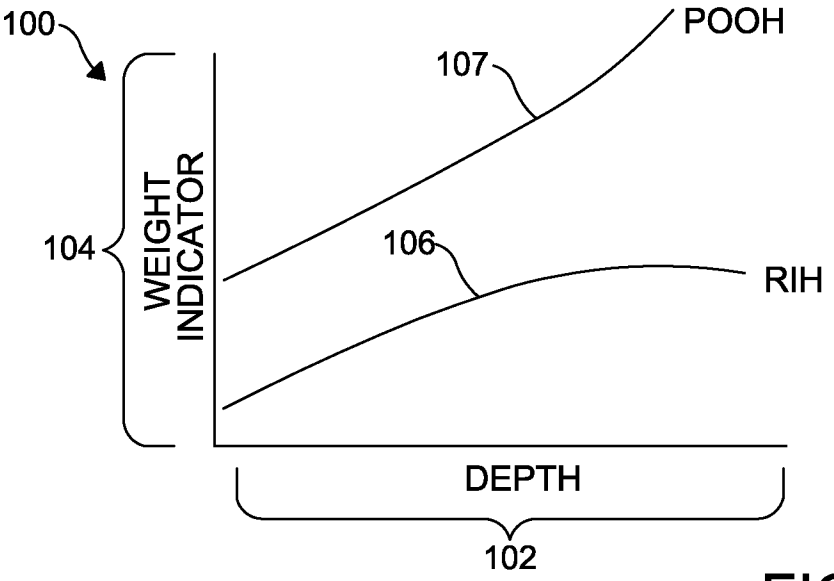
FIG. 2 is a graphical plot of a simulated data model of a simulated weight indicator for a tubing with respect to a depth of a portion of the tubing in a wellbore.

In use, a tubing forces model (TFM) or simulated model is generated based upon a plurality of simulated and known parameters relating to the tubing 16 and the wellbore in which the tubing 16 is deployed. As an illustrative example, FIG. 2 includes a graphical plot 100 representing results of a TFM, wherein an X-axis 102 of the graphical plot 100 represents a depth of the BHA 12 in the wellbore measured from a predetermined surface level and a Y-axis 104 of the graphical plot 100 represents a surface weight indicator. As shown, a first simulated model curve 106 (e.g. as predicted by simulated parameters of the TFM) is illustrated for the tubing 16 "running in hole" (RIH) and a second simulated model curve 107 (e.g. as predicted by simulated parameters of the TFM) is illustrated for the tubing 16 pulling out of hole (POOH).

As a non-limiting example, one factor affecting the forces on the tubing 16 (and the resultant simulated model curves 106, 107) is the buoyancy force of a fluid in the wellbore. The simulated model often includes a parameter representing a density of the fluid in the well (as well as the fluid pumped through the coiled tubing). Accordingly, the resulting simulated model curves 106, 107 are representative of a simulated density of the fluid in the well. However, in actual CT operations, the fluid that is initially in the well and its level is often unknown. Furthermore, various types of fluids having different characteristics can be pumped into the well during particular operation (e.g. compressible fluid such as nitrogen and solids can be picked up by a jetting tool during fill cleanout). As such, multiple factors lead to a highly uncertain simulated fluid density in the wellbore and, therefore, errors in simulated model (e.g. TFM) calculations and the resultant simulated model curves 106, 107.

To obtain a more accurate simulated model including tubing forces calculation, the actual measurement of downhole parameters (e.g. pressure external to the tubing 16) can be used to compute an updated simulated model (e.g. TFM) including an apparent fluid density in the well, for example. In order to obtain accurate tubing forces calculation and maintain the ability of using the simulated model (e.g. TFM) to predict a maximum reach of the tubing 16 in the wellbore, the input parameters for the simulated model need to be calibrated utilizing the real-time downhole and surface measurements received from the sensors 24, 26.

For example, in an extended reach well, a friction coefficient between the tubing 16 and the wellbore plays a critical role in terms of how far the tubing 16 can be deployed into the well. However, before one can correctly calibrate the friction coefficient, the external forces acting on the tubing 16 (e.g. stripper force and reel back tension) and additional frictional force due to residual bending need to be calibrated.

In certain embodiments, the BHA 12 is disposed in a vertical section of the wellbore in which the gravitation induced friction is not present. Based on the known or simulated input parameters and utilizing the actual measured surface and downhole pressures, the simulated model (e.g. TFM) calculates the expected surface weight indicator. The calculated weight indicator is compared to the actual measured weight indicator measured by at least one of the surface sensors 24, as shown in FIG. 3A.

Figure 3B:
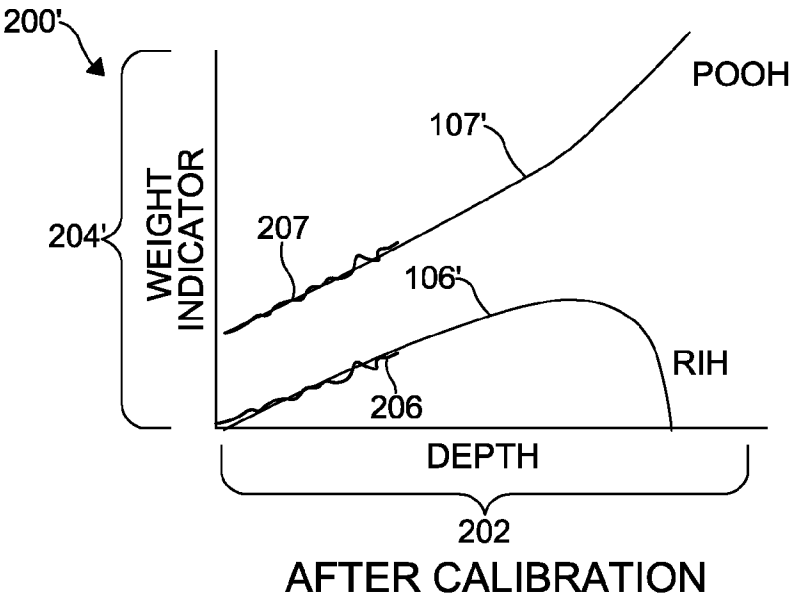
FIG. 3B is a graphical plot of the measured data model and simulated data model of FIG. 3A, showing the simulated data model in a post-calibration configuration.
Figure 3A:
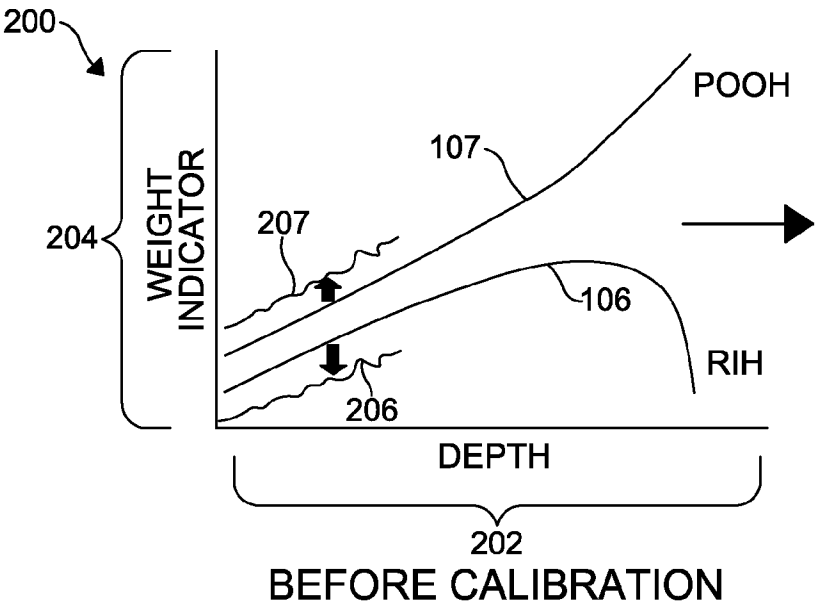
FIG. 3A is a graphical plot of a measured data model of a weight indicator for the tubing of FIG. 2 overlaying the simulated data model of FIG. 2, the simulated data model in a pre-calibration configuration.

In particular, FIG. 3A includes a graphical plot 200 of a comparison between a simulated model and actual measurements, wherein an X-axis 202 of the graphical plot 200 represents a depth of the BHA 12 in the wellbore measured from a pre-determined surface level and a Y-axis 204 of the graphical plot 100 represents a surface weight indicator. As shown, a first simulated model curve 106 (e.g. as predicted by simulated parameters of the TFM) is illustrated for the tubing 16 "running in hole" (RIH) and a second simulated model curve 107 (e.g. as predicted by simulated parameters of the TFM) is illustrated for the tubing 16 pulling out of hole (POOH). Further, a first data model curve 206 (based upon a direct measurement of at least one of the surface sensors 24 or a calculation based thereon) is illustrated for the tubing 16 running in hole (RIH) and a second data model curve 207 (based upon a direct measurement of at least one of the surface sensors 24 or a calculation based thereon) is illustrated for the tubing 16 pulling out of hole (POOH), respectively.

The simulated model curves 106, 107 may deviate from actual or measured data model curves 206, 207 as shown in FIG. 3A. If input parameters such as a pressure and a fluid density are substantially accurate, the difference between the simulated model curves 106, 107 and the data model curves 206, 207 can often be corrected by adjusting a parameter of the simulated model (e.g. adding a frictional force) resulting in calibrated simulated model curves 106', 107' that substantially match the data model curves 206, 207 (i.e. measured weight indicator), as illustrated in the graphical plot 200' of FIG. 3B. It is understood that the calibrated frictional force accounts for various uncertainties in the original simulated model including the uncertain contact friction due to residual bending as well as potential inaccurate stripper force entered by the operator.

Once the inaccurate frictional forces have been calibrated, the coefficient of friction between the tubing 16 and wellbore wall can be calibrated as the tubing 16 enters the deviated or horizontal section of the well. Utilizing known or simulated input parameters, a surface pressure measured by at least one of the surface sensors 24, a downhole pressure measured by at least one of the wellbore sensors 26, and a load measurement on the BHA 12 measured by at least one of the wellbore sensors, the simulated model (e.g. TFM) can be used to determine the parameter representing a coefficient of friction between the tubing 16 and the wellbore.

Figure 4B:
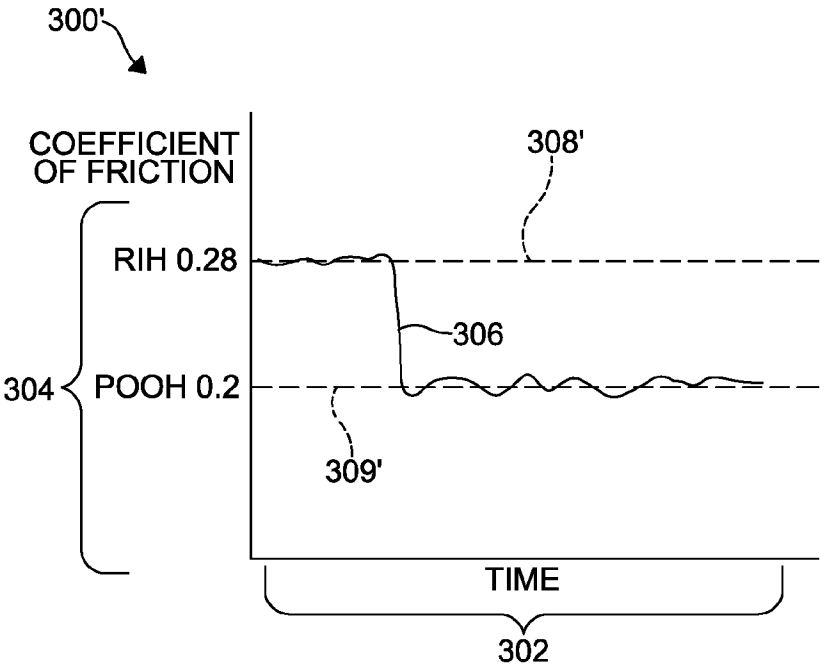
FIG. 4B is a graphical plot of a calibrated parameter of the simulated data model showing the calibrated parameter overlaying a plot of pre-defined assumed values of the coefficient friction between the tubing and the wellbore of FIG. 2, the pre-defined assumed values shown in a post-calibration configuration.
Figure 4A:
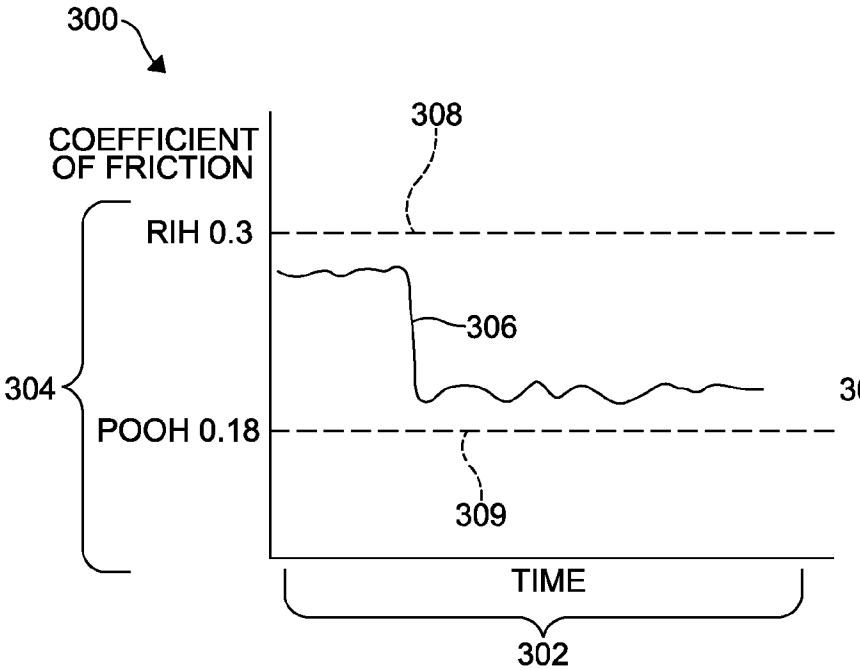
FIG. 4A is a graphical plot of a calibrated parameter of the simulated data model showing the calibrated parameter overlaying a plot of pre-defined assumed values of the coefficient friction between the tubing and the wellbore of FIG. 2, the pre-defined assumed values shown in a pre-calibration configuration.

The calculated coefficient of friction can be plotted in real time, as shown in FIGS. 4A and 4B. FIG. 4A includes a graphical plot 300 of a comparison between a pre-determined coefficient of friction parameter (e.g. an assumed value used initially for the job design) and a coefficient of friction parameter of the calibrated simulated model, wherein an X-axis 302 of the graphical plot 300 represents a time and a Y-axis 304 of the graphical plot 300 represents a coefficient of friction between the tubing 16 and the wellbore. As shown, a calibrated simulated model curve 306 (e.g. representing a parameter of the calibrated simulated model curves 106', 107') is illustrated for the tubing 16 "running in hole" (RIH) and pulling out of hole (POOH). Additionally, a first assumed value 308 is plotted for the tubing running in hole (RIH) and a second assumed valued 309 is plotted pulling out of hole (POOH).

As illustrated as in FIG. 4A, the curve 306 may not agree with the assumed values 308, 309 used initially for the job design. By adjusting the assumed values 308, 309 to substantially match the curve 306, a plurality of calibrated values 308', 309' of the parameter (e.g. coefficient of friction) can be used to update or re-generate the simulated models (e.g. TFM) for various well operations, as shown in the graphical plot 300' of FIG. 4B.

It is understood that the calibrated values 308', 309' of the coefficient of friction as shown in FIG. 4B may not be the absolute friction between the tubing 16 and the wellbore, but rather an apparent friction that takes into account other factors that lead to higher drag on the tubing 16. It is further understood that an increase in the apparent friction can be due to a number of different mechanisms such as solids accumulation in the wellbore, collapse of open hole section, differential sticking (an effect caused by the wellbore pressure greater than the formation pressure that pushes the tubing 16 against the wellbore), the BHA 12 passing through a restriction or "dog-leg" in the hole, or as the tubing 16 starts to buckle. As the apparent friction increases, a curve representing the value of a coefficient of friction (e.g. simulated model curve 306) deviates from a previous base line. An operator who monitors the simulated model curve 306, can notice a deviation (e.g. uptick) and be warned of potential risk of the tubing 16 getting stuck or other operational problems. A computer program can also be used to monitor a deviation in the simulated model curve 306 and automatically generate a warning to alert the operator.

In the above description, the disclosure is illustrated through its application in coiled tubing. However, the disclosure is equally applicable to other means of conveyance such as, but not limited to, conventional jointed pipes and cables.

Disclosed is a system 10 and methods for using a downhole pressure, a temperature, and a bottom load measurement, along with a surface weight indicator, to predict the apparent coefficient of friction between the tubing 16 and wellbore wall.

Further disclosed is a method for calibrating the apparent friction force in the well due to inaccurate or unknown CT stripper force, reel back tension, and CT/well contact force due to residual bend in vertical section. This calibration allows more accurate determination of apparent coefficient of friction.

Further disclosed is a method for using the computed apparent coefficient of friction as a drag indicator for detecting increased drag and potential stuck-pipe situation during CT cleanout operations as a result of fill accumulation in the well, or during CT interventions to access deviated/horizontal open hole completions.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method for determining characteristics of a coiled tubing deployed in a wellbore formed in a formation, comprising:

positioning a sensor within the wellbore along with the coiled tubing, wherein the sensor generates a feedback signal representing a downhole parameter measured by the sensor;

generating a pre-defined value for a coefficient of friction between the coiled tubing and the wellbore;

generating a simulated model including a parameter representing an apparent coefficient of friction between the coiled tubing and the wellbore, the simulated model representing forces acting on the coiled tubing, wherein the simulated model is derived from at least the downhole feedback signal;

comparing a value of the parameter representing the apparent coefficient of friction between the coiled tubing and the wellbore to the pre-defined value;

adjusting the pre-defined value to substantially match the value of the parameter representing the apparent coefficient of friction between the coiled tubing and the wellbore of the simulated model;

generating and analyzing the simulated model in real-time to determine a change affecting deployment of the coiled tubing; and controlling the deployment of the coiled tubing in response to the analysis of the simulated model.

2. The method according to claim 1, further comprising:

positioning a second sensor adjacent a surface of the formation in which the wellbore is formed, wherein the second sensor generates a second feedback signal representing a surface parameter measured by the second sensor;

generating a simulated model representing a simulated surface weight indicator of the tubing, wherein the surface weight simulated model is derived from at least the first feedback signal;

generating a data model representing a measured weight indicator of the tubing, wherein the data model is derived from the second feedback signal;

comparing the data model to the simulated model; and adjusting a parameter of the simulated model to substantially match the simulated model to the data model.

3. The method according to claim 2 wherein the first sensor is positioned in a substantially vertical section of the wellbore.

4. The method according to claim 2 wherein the surface parameter measured by the second sensor is a surface pressure.

5. The method according to claim 4 wherein the simulated model is derived from at least the surface pressure.

6. The method according to claim 2 wherein the surface parameter measured by the second sensor is a surface weight indicator of the tubing.

7. The method according to claim 2 further comprising the step of calculating a simulated density of a fluid in the wellbore based upon at least the downhole parameter measured by the first sensor, wherein the simulated model is derived from at least the simulated density of a fluid in the wellbore.

8. The method according to claim 2 wherein the simulated model is generated based upon at least one known characteristic of at least one of the tubing and the wellbore.

9. The method according to claim 2 comprising:

wherein generating a simulated model comprises generating a simulated model based upon an instruction set and analyzing the at least one parameter in real-time to determine a change in characteristics of at least one of the tubing and the wellbore.

10. The method according to claim 1 wherein the downhole parameter measured by the first sensor is one of a downhole pressure, a downhole temperature, and a load on the tubing.

11. The method according to claim 1 further comprising the step of positioning a second sensor adjacent a surface of the formation in which the wellbore is formed, wherein the second sensor generates a second feedback signal representing a surface parameter measured by the second sensor, and wherein the simulated model is derived from at least the second feedback signal.

12. The method according to claim 1 wherein analyzing comprises at least detecting increased drag and a potential stuck-pipe situation.

13. The method according to claim 1 further comprising updating the apparent coefficient of friction from the simulated model based on the downhole feedback signal, comparing the apparent coefficient of friction to the adjusted pre-defined value, and analyzing the compared values to determine operational problems.

14. The method according to claim 1 further comprising updating or re-generating the simulated model for a well operation based on the generated apparent coefficient of friction.

15. The method according to claim 1 wherein the pre-defined value comprises at least a running in hole (RIH) value and a pulling out of hole (POOH) value.

16. The method according to claim 1 further comprising performing a well intervention operation with the coiled tubing.

17. The method according to claim 16 wherein performing a well intervention operation comprises performing a cleanout operation and wherein controlling comprises adjusting the cleanout operation based on the apparent coefficient of friction.

* * * * *